US007901121B2

(12) United States Patent
Ohshio et al.

(10) Patent No.: US 7,901,121 B2
(45) Date of Patent: Mar. 8, 2011

(54) VEHICULAR LAMP SYSTEM

(75) Inventors: Hirohiko Ohshio, Shizuoka (JP); Kiyotaka Mochizuki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 74 days.

(21) Appl. No.: 12/257,745

(22) Filed: Oct. 24, 2008

(65) Prior Publication Data

US 2009/0116259 A1 May 7, 2009

(30) Foreign Application Priority Data

Nov. 2, 2007 (JP) ..... 2007-286034

(51) Int. Cl.
*F21V 17/02* (2006.01)

(52) U.S. Cl. ..... 362/512; 362/467; 362/507

(58) Field of Classification Search ..... 362/464, 362/465, 469, 467, 507, 512
See application file for complete search history.

(56) References Cited

U.S. PATENT DOCUMENTS 4,967,319 A * 10/1990 Seko ..... 362/466
5,645,338 A * 7/1997 Kobayashi ..... 362/466
5,660,454 A * 8/1997 Mori et al. ..... 362/466
5,899,559 A * 5/1999 Lachmayer et al. ..... 362/513
6,623,149 B2 * 9/2003 Leleve ..... 362/512
7,090,385 B2 * 8/2006 Sugimoto ..... 362/539
7,201,505 B2 * 4/2007 Sugimoto et al. ..... 362/539
7,568,825 B2 * 8/2009 Louvet et al. ..... 362/539
7,618,173 B2 * 11/2009 Sugimoto et al. ..... 362/518

FOREIGN PATENT DOCUMENTS

JP 2006-221882 8/2006

* cited by examiner

*Primary Examiner* — John A Ward
(74) *Attorney, Agent, or Firm* — Fish & Richardson P.C.

(57) ABSTRACT

The light distribution of a vehicle headlamp can be changed between various modes, including a basic mode and a motorway mode. In the basic mode, shaded region changeover means block a high light intensity region, and deflection control means controls a lamp optical axis Lx to a straight travel direction. In the motorway mode, the shaded region changeover means does not block the high light intensity region, and the deflection control means controls deflection of the lamp optical axis to a host vehicle lane side. A light distribution in which the high light intensity region faces a far distance ahead of the host vehicle lane can be obtained, and the host vehicle lane is brightly illuminated without dazzling a driver of a preceding vehicle or an oncoming vehicle. Accordingly, illumination suited to the motorway mode during high speed and medium speed travel can be achieved.

8 Claims, 7 Drawing Sheets

VEHICULAR LAMP SYSTEM

CROSS REFERENCE TO RELATED APPLICATION

This application claims the benefit of priority from Japanese application 2007-286034, filed on Nov. 2, 2008. The contents of that application are incorporated herein by reference.

TECHNICAL FIELD

The present disclosure relates to a lamp system suitable for application to a headlamp of a vehicle such as an automobile, and more specifically, to a vehicular lamp system capable of changing to an appropriate light distribution mode depending on various travel conditions of the vehicle.

BACKGROUND

An automobile headlamp conventionally is capable of changing between two modes: a high beam mode (traveling mode) with a light distribution pattern for brightly illuminating a far distance ahead which is suitable for country driving, and a basic mode (passing mode) with a light distribution pattern for illuminating an area in front of a host vehicle while suppressing glare with respect to another vehicle in cases of city driving where there is another vehicle such as an oncoming vehicle or a preceding vehicle. However, various light distribution modes have been proposed in recent year for achieving suitable illumination for every travel condition of the automobile. Examples include a motorway mode for increasing a distant illumination intensity ahead during high speed travel of the host vehicle within a range that does not interfere with the driver of an oncoming vehicle, and a wet road mode that reduces interference with the driver of an oncoming vehicle, which is due to light radiated directly in front of the host vehicle during travel in rainy weather that reflects off the road surface.

In order for the headlamp to change between the light distribution patterns of the high beam mode, the basic mode, the motorway mode, and the wet road mode, multiple shades having different light-blocking patterns conventionally are provided for partially shading light emitted from a light source of a lamp. A target light distribution pattern then is obtained by selecting and changing between these shades. However, it is difficult to obtain light distribution patterns suitable for travel conditions by simply changing between the shades alone. Therefore, changing the shade and varying an illumination optical axis of the lamp at the same time also has been proposed. For example, Japanese Patent Laid-Open Application (Kokai) No. 2006-221882 proposes a headlamp in which a lamp reflector is vertically tiltable and a shade in the lamp is changeable. Tilting the shade varies a shaded region of light emitted from a lamp light source. According to the foregoing patent application, a light distribution pattern can be varied slightly by tilting the shade to change the shaded region, and by tilting the reflector to vary an illumination optical axis. Thus, a light distribution pattern suitable for a particular travel condition can be obtained.

In the foregoing patent application, the reflector is vertically tilted to vary the illumination optical axis in the vertical direction. Therefore, the light intensity distribution of the light distribution pattern is only changed in the longitudinal direction when looking at the road surface from the vertical direction, i.e., when looking at the road surface ahead from the host vehicle. As a consequence, a brightest light intensity region of the light intensity distribution may be blocked when the shade is changed, which means that a light distribution suitable for a particular travel condition may not be obtained. For example, FIG. 3(*a*) shows a light distribution region of the lamp when light is not blocked by the shade (i.e., a light distribution pattern for a high beam mode), and FIG. 3(*b*) shows a light distribution pattern for a basic mode when the light distribution region is partially blocked by the shade. Ax is an axis representing a straight travel direction of the host vehicle (hereinafter referred to as a straight travel axis), and V and H are a vertical line and a horizontal line that pass through the straight travel axis Ax, respectively. In addition, the illumination region is indicated by light intensity contour lines in order to illustrate the distribution of light intensity schematically. The center is a high light intensity region. In the basic mode, the central high light intensity region of the illumination region is shaded so that the driver of an oncoming vehicle is not dazzled. In contrast to the light intensity distribution, in order to set the motorway mode, which illuminates a far distance ahead of a host vehicle lane ML at a high light intensity, the shade is used to change the shaded region so that the high light intensity region is not partially blocked. However, part of the high light intensity region overlaps with an oncoming vehicle lane OL as shown in FIG. 3(*c*), which may dazzle the driver of the oncoming vehicle as well as a preceding vehicle. Accordingly, when there is an oncoming vehicle or a preceding vehicle present during high speed travel, illumination must be changed and set to that of the basic mode as shown in FIG. 3(*b*), which results in inadequate brightness at a far distance ahead of the host vehicle lane ML. In the foregoing patent application, the headlamp can rotate laterally. This configuration is used so that the headlamp can follow and deflect in accordance with steering of the automobile; however, the light distribution pattern is not deflected during a straight travel condition of the host vehicle.

In the foregoing patent application, light distribution according to the wet road mode cannot readily be achieved. To achieve light distribution according to the wet road mode, it is necessary to shade reflected light headed toward an oncoming vehicle or a preceding vehicle on the road surface in the directly forward region of the host vehicle as indicated by a broken line WA in FIG. 3(*c*). To this end, a shade that blocks a lower region must be provided in addition to a shade that blocks an upper region of the illumination region of the lamp. In addition, a structure is needed to change between blocking and not blocking light using this shade. However, this results in a more complex lamp structure. Costs and other factors, make the realization of a headlamp compatible with the above wet road mode difficult.

SUMMARY

The present disclosure describes a vehicular lamp system capable of realizing light distributions suitable for a high beam mode and a basic mode, as well as other modes, particularly a motorway mode and a wet road mode.

According to one aspect, a vehicular lamp system includes shading means for partially shading light emitted from a lamp to vary a light distribution pattern; shaded region changeover means for changing a shaded region using the shading means; and deflection control means for controlling deflection of a lamp optical axis in a lateral direction. The shaded region changeover means is capable of changing between states where a high light intensity region of an illumination region of the lamp is shaded and not shaded, and the deflection control means controls deflection of the lamp optical axis in accordance with a shaded state of the high light intensity region due to the shaded region changeover means. The high light intensity region refers to a region of light intensity higher than a preset light intensity within the entire light region radiated from the lamp. For example, if the entire region is divided into regions of equal light quantities at predetermined steps, then the high light intensity region is surrounded by a contour line indicating the highest light intensity. Furthermore, the shaded state includes a condition in which substantially the entire high light intensity region is shaded, and the non-shaded state includes a condition in which at least half of the high light intensity region is not shaded.

According to the present disclosure, a light distribution can be obtained for a high beam mode that is appropriate for a travel condition in which the high light intensity region is not shaded and a region up to a far distance ahead of the host vehicle is brightly illuminated. In addition, a light distribution can be obtained for a basic mode that shades the high light intensity region to prevent dazzling of the driver of an oncoming vehicle or a preceding vehicle and that brightly illuminates forward of the host vehicle in a medium speed or slower travel condition. Furthermore, a light distribution can be obtained for a motorway mode in which the high intensity region is not shaded, but the lamp optical axis is deflected either rightward or leftward to prevent dazzling of the driver of an oncoming vehicle or a preceding vehicle and that brightly illuminates a region up to a far distance ahead of the host vehicle in a high speed travel condition. Moreover, a light distribution can be obtained for a wet road mode suitable for a rainy travel condition. Therefore, in addition to the high beam mode and the basic mode, light distributions can be realized for various modes corresponding to different travel conditions of the host vehicle.

A vehicular lamp system according to the present disclosure is capable of changing the light distribution between at least a basic mode and a motorway mode, for example. In the basic mode, shaded region changeover means blocks light in a high light intensity region and deflection control means controls a lamp optical axis to a straight travel direction. In the motorway mode, the shaded region changeover means does not block light in the high light intensity region, and the deflection control means controls deflection of the lamp optical axis to a host vehicle lane side. Thus, a light distribution wherein the high light intensity region faces a far distance ahead of the host vehicle lane can be obtained, and the host vehicle lane is brightly illuminated without dazzling the driver of a preceding vehicle or an oncoming vehicle. Accordingly, illumination suited to the motorway mode during high speed and medium speed travel can be achieved.

The vehicular lamp system preferably includes leveling means that controls vertical deflection of a lamp illumination optical axis. Thus, light distributions with varied high light intensity regions in a vertical direction can be obtained, making it possible to realize more light distribution in modes that correspond to different travel conditions of a host vehicle. The vehicular lamp system according to the present invention is capable of changing the light distribution between at least the basic mode and a wet road mode, for example. In the basic mode, shaded region changeover means blocks light in a high light intensity region and deflection control means controls a lamp optical axis to a straight travel direction. In the wet road mode, the shaded region changeover means does not block light in the high light intensity region, the deflection control means controls deflection of the lamp optical axis to a host vehicle lane side, and the leveling means controls deflection of the lamp optical axis upward. Thus, a light distribution can be obtained with a high light intensity region facing a far distance ahead of the host vehicle lane and a reduced light intensity in a region directly forward of the host vehicle lane, but at the same time without dazzling the driver of a preceding vehicle or an oncoming vehicle. Furthermore, it is possible to prevent dazzling of the driver of a preceding vehicle or an oncoming vehicle due to reflected light on the wet road surface directly in front of the host vehicle lane, thereby realizing illumination suited to the wet road mode.

When changing from the basic mode to the motorway mode or the wet road mode, deflecting means and/or the leveling means perform a deflecting control or a leveling control before a shaded region changeover control of the shaded region changeover means. When changing from the motorway mode or the wet road mode to the basic mode, the shaded region changeover control of the shading means is performed before the deflecting control or the leveling control. If there is a preceding vehicle or an oncoming vehicle present, then a situation in which the high light intensity region faces the preceding vehicle or the oncoming vehicle when the light distribution is changed can be prevented, thus reliably preventing dazzle.

Furthermore, the shading means has right and left horizontal cut-off lines of different heights, as well as an oblique cut-off line that connects the two cut-off lines. The shaded region changeover means preferably changes a horizontal position of the oblique cut-off line in the motorway mode and the wet road mode, whereas the deflection control means preferably sets the oblique cut-off line to practically identical horizontal positions in the motorway mode and the wet road mode. Dazzling of the driver of an oncoming vehicle can thus be reliably prevented in both the motorway mode and the wet road mode.

Other aspect of the invention, and various features and advantages, will be apparent from the following description, the accompanying drawings, and the claims.

DETAILED DESCRIPTION

First Embodiment

Figure 1:
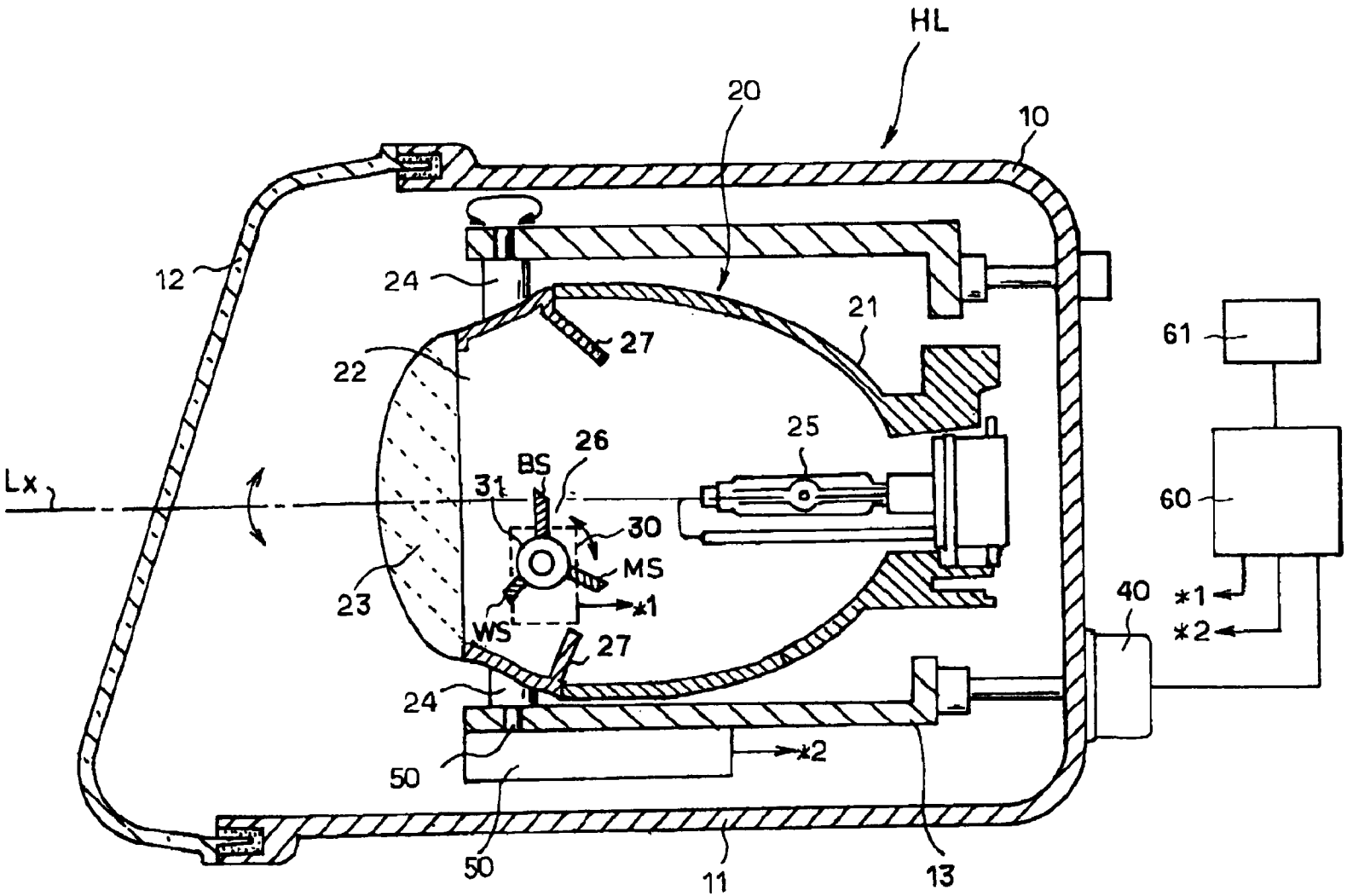
FIG. 1 is a cross-sectional view of a headlamp according to a first embodiment.
Figure 2A:
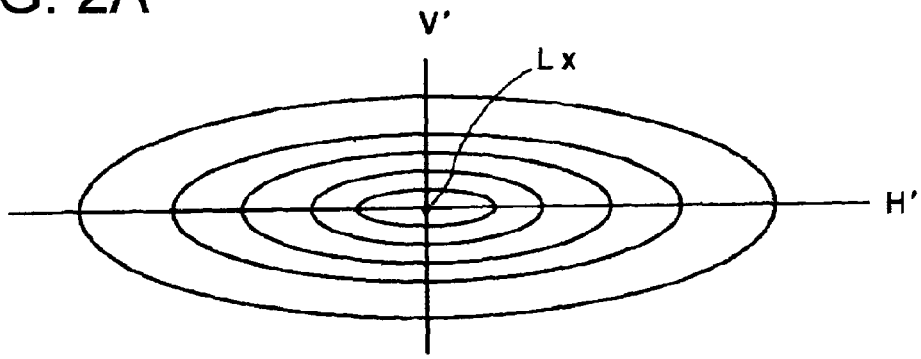
FIG. 2 shows views for explaining shaded regions of multiple shades in the headlamp according to the first embodiment.
Figure 2B:
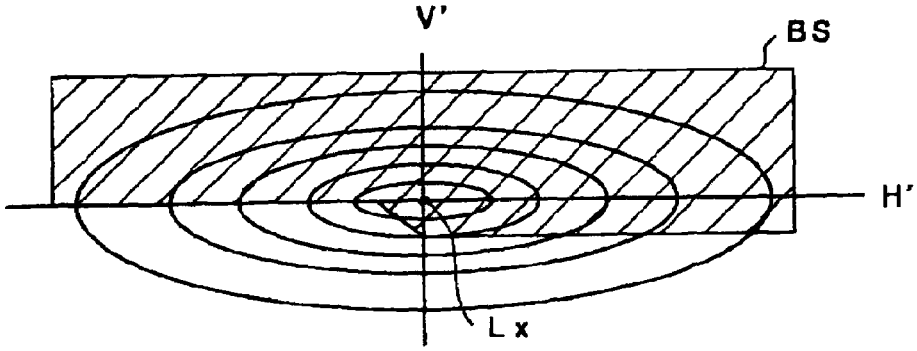
Figure 2C:
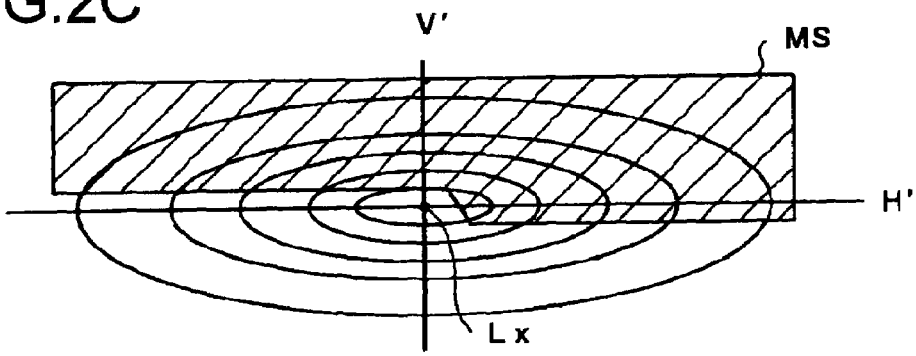
Figure 2D:
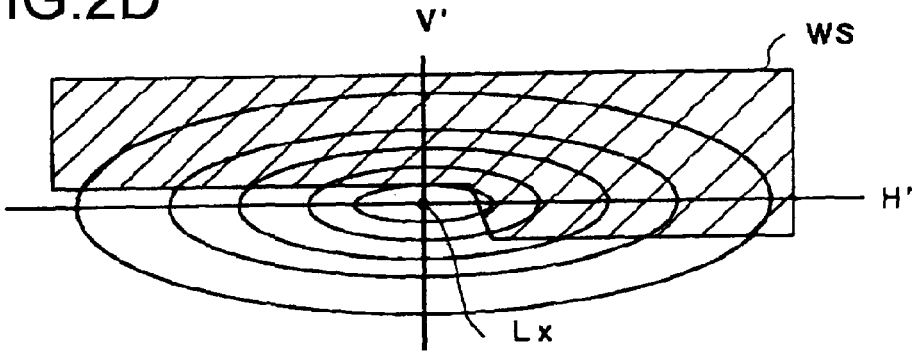

FIG. 1 is a cross-sectional view of a headlamp HL for right and left sides of an automobile. The headlamp HL uses a projector lamp unit; the same structure is employed for both right and left sides. In the headlamp HL, a lamp housing 10 is includes a lamp body 11 and a translucent cover 12 that is attached to a front opening of the lamp body 11. A projector lamp unit 20 is mounted within the lamp housing 10. A generally C-shaped frame 13 also is mounted within the lamp housing 10. The projector lamp unit 20 is supported rotatably in horizontal right and left directions by top and bottom rotational shafts 24 within the frame 13.

The projector lamp unit 20 includes a container-like reflector 21 with a generally spheroidal shape, a light source 25 that is arranged in the vicinity of a first focal point of the reflector 21, and a condenser lens 23 that is supported by a holder 22 on a front edge portion of the reflector 21 and whose rear-side focal point is arranged in the vicinity of a second focal point of the reflector 21. Also supported within the projector lamp unit 20 is a main shade 26 that acts as shading means for partially blocking light emitted from the light source 25 and reflected by the reflector 21. According to the first embodiment, a sub shade 27 is integrated with the holder 22 for blocking scattered light heading toward a surrounding region of a light distribution pattern. The main shade 26 is arranged in the vicinity of the second focal point of the reflector 21, and is structured so as to mainly block emitted light heading upward of a lamp optical axis Lx.

The main shade 26 is structured as a variable shade so as to dissimilate a region of shaded light (hereinafter referred to as a shaded region) and enable switching between different light distribution patterns. In the first embodiment, the main shade 26 is structured as a rotary shade that dissimilates the shaded region to change to a different pattern by varying a rotational position. In addition, the rotary shade 26 has a rotational support shaft 31 whose rotational position can be controlled by a rotational shade mechanism 30 that uses a motor as a drive source, for example, and from multiple shade plates with different shapes that are supported in a radial configuration at different circumferential positions on a peripheral surface of the rotational support shaft 31. In the present example, there are multiple plates that serve as at least three shades: a basic plate BS, a motorway plate MS, and a wet road plate WS. The rotational shade mechanism 30 serves as the shaded region changeover means.

FIGS. 2(*a*) to 2(*d*) are views that schematically show shaded regions made by the shade plates shown in FIG. 1, and illustrate the shaded regions on a light distribution pattern ahead of the host vehicle from the light source side along the lamp optical axis Lx. The lamp optical axis Lx is a straight line that passes through the first and second focal points of the reflector 21, and is an optical central axis of the projector lamp unit 20. FIG. 2(*a*) is a light distribution pattern when the main shade 26 does not block light, wherein the light distribution indicates a light intensity distribution in a stepped fashion by light intensity contour lines in order to show that the center has a high light intensity, and the light intensity is reduced gradually toward the periphery. A region surrounded by a contour line at the center denotes the high light intensity region for convenience, and the high light intensity region coincides with the lamp optical axis Lx. V' is a vertical line that passes through the lamp optical axis Lx, and H' is a horizontal line that passes through the lamp optical axis Lx. As FIG. 2(*b*) shows, the basic plate BS creates a pattern wherein a region to the right of the lamp optical axis Lx has a cut-off line at a position lower than the horizontal line H' passing through the lamp optical axis Lx, and a region to the left of the lamp optical axis Lx has a cut-off line at a position substantially level with the horizontal line H'. The pattern also has an oblique cut-off line that shades light from a high light intensity region that includes the lamp optical axis Lx. As FIG. 2(*c*) shows, the motorway plate MS creates a pattern wherein the cut-off lines are positioned somewhat more upward than with the basic plate BS, and the cut-off lines in the regions to the right and left of the lamp optical axis Lx are set at slightly higher positions than with the basic plate BS. Furthermore, the oblique cut-off line is displaced somewhat rightward so as to shade only part of the right-side region of the high light intensity region that includes the lamp optical axis Lx. As FIG. 2(*d*) shows, the wet road plate WS creates a pattern wherein a height of the cut-off line in the region to the right of the lamp optical axis Lx is positioned at nearly the same height as with the basic plate BS, and a height of the cut-off line in the region to the left of the lamp optical axis Lx is substantially the same as that with the motorway plate MS, with the oblique cut-off line further deviated by a slight amount more rightward than with the motorway plate MS so that a region shading the high light intensity region that includes the lamp optical axis Lx is smaller than the region shaded by the motorway plate MS.

The frame 13 that supports the projector lamp unit 20 is supported vertically and is tiltable within the lamp housing 10. The frame 13 is tilted in the vertical direction by the leveling mechanism 40, which has a leveling actuator or the like. The tilting is linked with integrated tilting of the projector lamp unit 20, whereby the lamp optical axis Lx of the projector lamp unit 20 can be moved in the vertical direction. Furthermore, the projector lamp unit 20 is supported rotatably in the horizontal direction with respect to the frame 13 due to the rotational shafts 24 at the top and bottom of the holder 22. In particular, the rotational shaft 24 on the lower side is fixed to a lower surface of the frame 13 and connected with a rotational shaft 50*a* of a swivel mechanism 50, which has a swivel actuator or the like. The swivel mechanism 50 rotates the projector lamp unit 20 within a required angular range in the horizontal direction, whereby the lamp optical axis Lx can be moved in the horizontal right and left directions.

The rotational shade mechanism 30, the leveling mechanism 40, and the swivel mechanism 50 are connected to a lamp control device 60, which controls their respective operations. The lamp control device 60 is connected to a mode changeover switch 61, which enables changing between various modes. In the first embodiment, the modes include the high beam mode, the basic mode, the motorway mode, and the wet road mode. The mode changeover switch 61 can be arranged to detect the travel condition of the host vehicle using various sensors installed in the automobile, and then automatically change to a mode based on the detected travel condition.

Figure 3A:
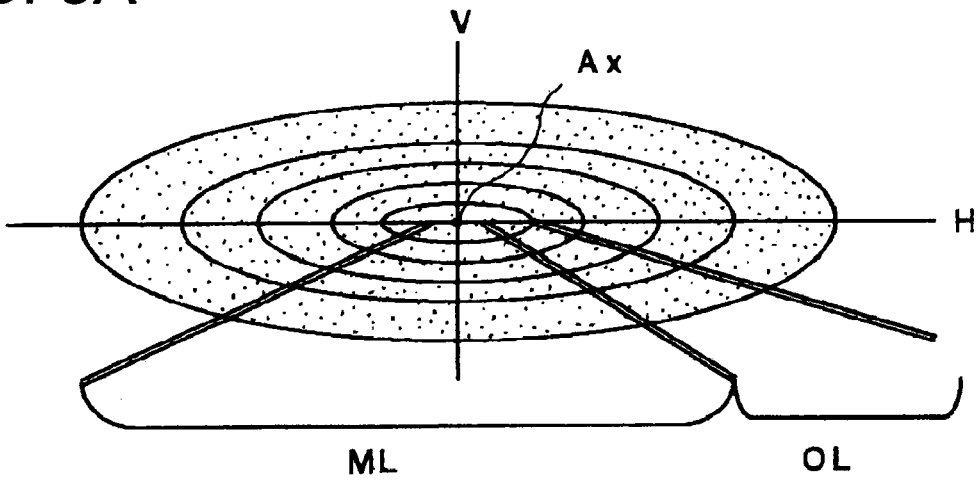
FIG. 3 shows views of light distribution according to a high beam mode and a basic mode, and a light distribution that is problematic for related art.
Figure 3B:
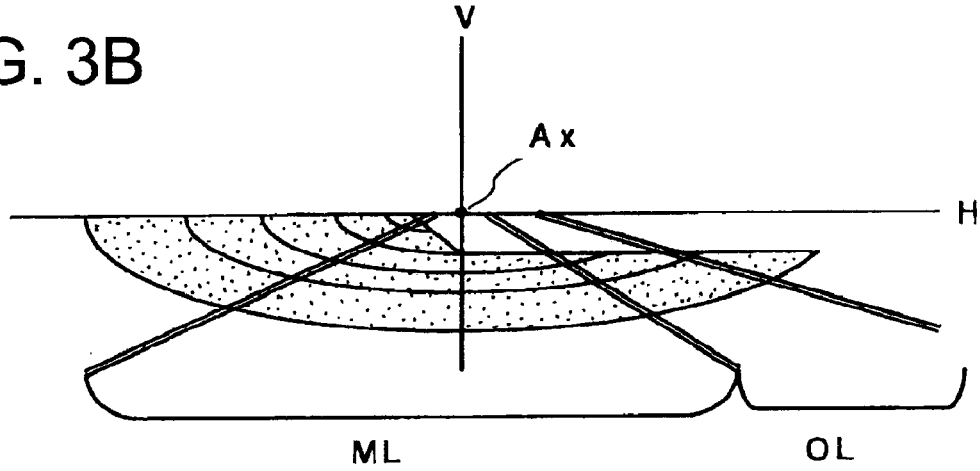
Figure 3C:
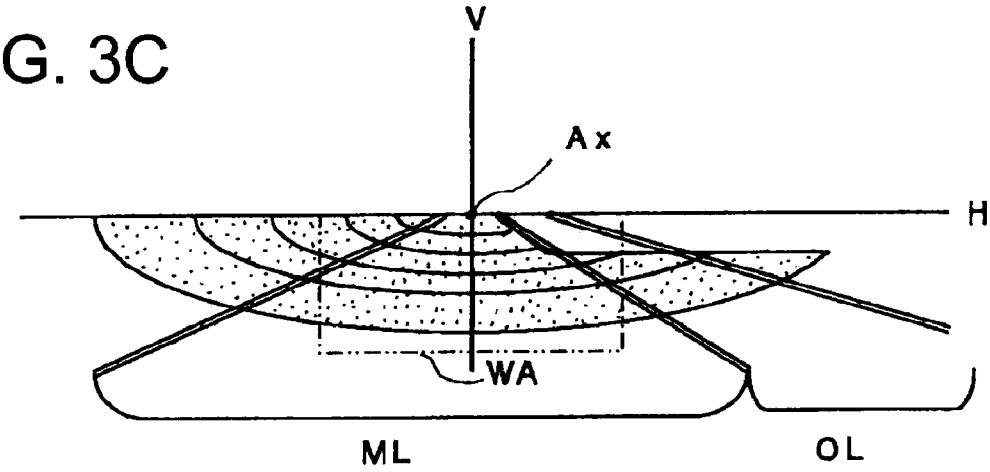

Next, a mode changeover operation performed by the headlamp HL structured as described above is explained. When the mode changeover switch 61 is set to the high beam mode, the lamp control device 60 controls rotation of the rotary shade 26 using the rotational shade mechanism 30 to achieve a state in which none of the shade plates is rotationally positioned within the path of reflected light from the reflector 21 of the projector lamp unit 20. At such time, the leveling mechanism 40 and the swivel mechanism 50 are used to control the lamp optical axis Lx of the projector lamp unit 20 so as to coincide with a straight travel axis Ax facing the straight travel direction of the host vehicle. Therefore, the light distribution pattern of the headlamp HL is a light distribution pattern that illuminates ahead of a host vehicle lane ML up to a distant region as shown in FIG. 3(*a*). OL in the figures denotes an oncoming vehicle lane.

Figure 4A:
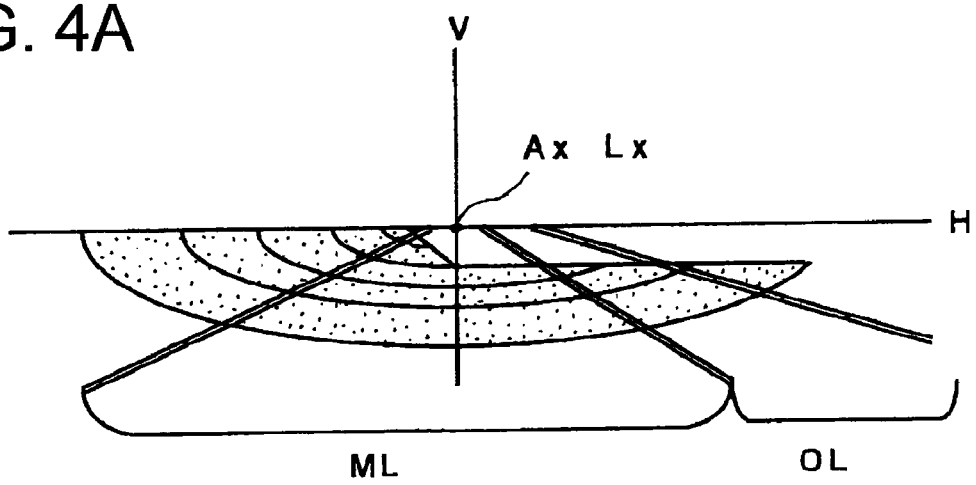
FIG. 4 shows views of changing between light distribution in a basic mode and a motorway mode according to the first embodiment.
Figure 4B:
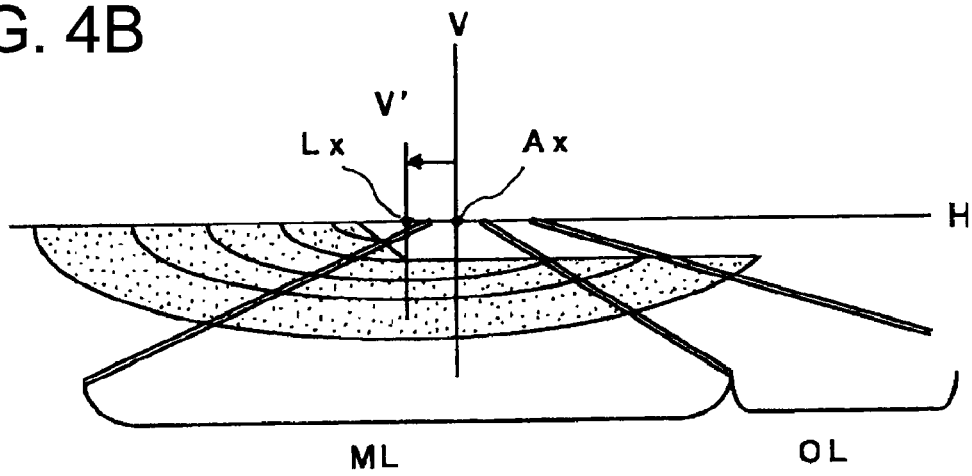
Figure 4C:
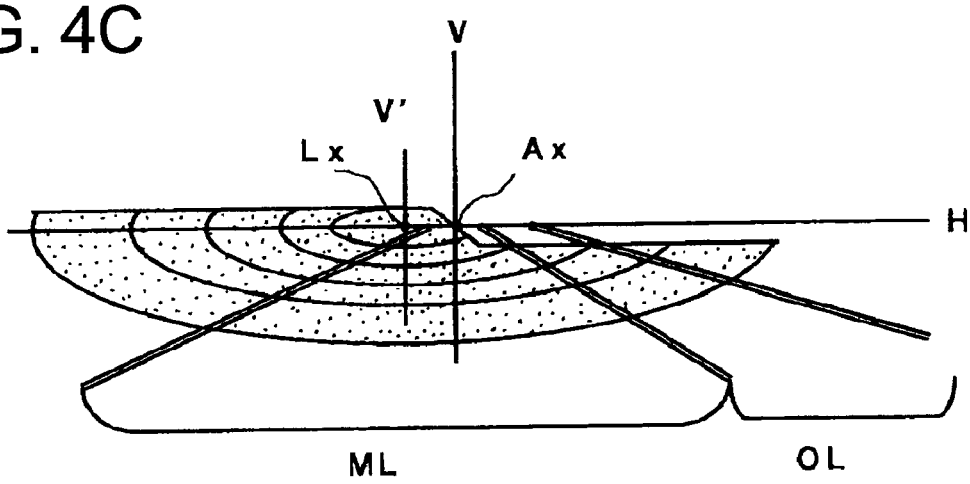

When the mode changeover switch 61 is set to the basic mode, the lamp control device 60 controls rotation of the rotary shade 26 using the rotational shade mechanism 30 to achieve a state in which the basic plate BS is rotationally positioned within the path of reflected light from the reflector 21 of the projector lamp unit 20. At such time, the leveling mechanism 40 and the swivel mechanism 50 are not operated, and the lamp optical axis Lx of the projector lamp unit 20 is maintained in a state facing the straight travel axis Ax of the host vehicle. Therefore, the light distribution pattern of the headlamp HL attains a shaded state due to the basic plate BS as shown in FIG. 2(*b*), and is a light distribution pattern that has a cut-off line at a position lower than the horizontal line H to the right of the straight travel axis Ax, and a cut-off line at a position practically along the horizontal line H to the left of the straight travel axis Ax as shown in FIG. 4(*a*). At such time, the high light intensity region along the straight travel axis Ax is shaded by the basic plate BS, thereby preventing dazzling of a driver of an oncoming vehicle or a preceding vehicle.

When the mode changeover switch 61 is changed from the basic mode shown in FIG. 4(*a*) to the motorway mode, the lamp control device 60 controls rotation of the rotary shade 26 using the rotational shade mechanism 30 to achieve a state in which the motorway plate MS is rotationally positioned within the path of reflected light from the reflector 21 of the projector lamp unit 20. At the same time, the swivel mechanism 50 is used to control deflection of the lamp optical axis Lx of the projector lamp unit 20 to a direction somewhat leftward of the straight travel axis Ax of the host vehicle (i.e., to a host vehicle lane side), as shown in FIG. 4(*c*). Therefore, the light distribution pattern of the headlamp HL attains a shaded state in a shaded region due to the motorway plate MS as shown in FIG. 2(*c*), and is a light distribution pattern that has a cut-off line at a position near the horizontal line H to the right of the straight travel axis Ax, a cut-off line at a position higher than the horizontal line H to the left of the straight travel axis Ax, and an oblique cut-off line at a position in the vicinity of the straight travel axis Ax, as shown in FIG. 4(*c*). There also is no shading of a region excluding a right side portion of the high light intensity region along the lamp optical axis Lx by the motorway plate MS, and a distant forward region of the host vehicle lane ML can be illuminated by the high light intensity region. Therefore, a light distribution pattern appropriate for high speed travel is achieved, where high light intensity illumination of a region of the oncoming vehicle lane OL to the right of the host vehicle lane ML is suppressed, while a distant forward region in the straight travel direction of the host vehicle lane ML is brightly illuminated.

When changing from the basic mode to the motorway mode, as shown in FIG. 4(*b*), leftward swiveling of the lamp optical axis Lx is controlled in advance with respect to the straight travel axis Ax. Thereafter, the rotary shade 26 is changed to the motorway plate MS. If the shade is changed first, then the entire high light intensity region (excluding a portion on the right side thereof) is set to a non-shaded state with the lamp optical axis Lx facing the straight travel axis Ax. As a consequence, this region faces a distant region of the host vehicle lane ML and the oncoming vehicle lane OL, and may dazzle the driver of an oncoming vehicle or a preceding vehicle. By first swiveling the lamp optical axis Lx leftward as in the first embodiment, even if substantially the entire high light intensity region (excluding a portion on the right side thereof) is not shaded, this region does not face the distant region of the host vehicle lane ML or the oncoming vehicle lane OL and the driver of an oncoming vehicle or a preceding vehicle is not dazzled. For the same reasons as given above, when changing from the motorway mode to the basic mode, it is preferable that the rotary shade 26 be changed from the motorway plate MS to the basic plate BS first, after which swiveling of the lamp optical axis Lx is controlled to face the straight travel axis Ax.

Figure 5A:
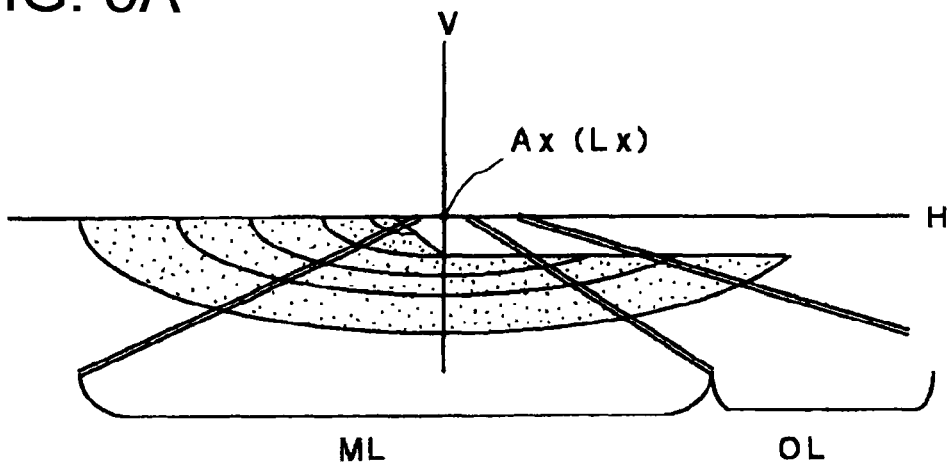
FIG. 5 shows views of changing between light distribution in the basic mode and a wet road mode according to the first embodiment.
Figure 5B:
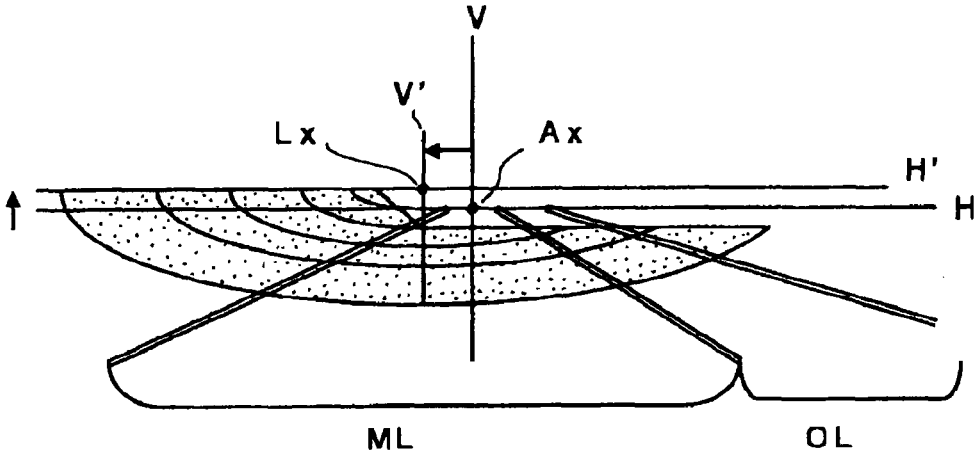
Figure 5C:
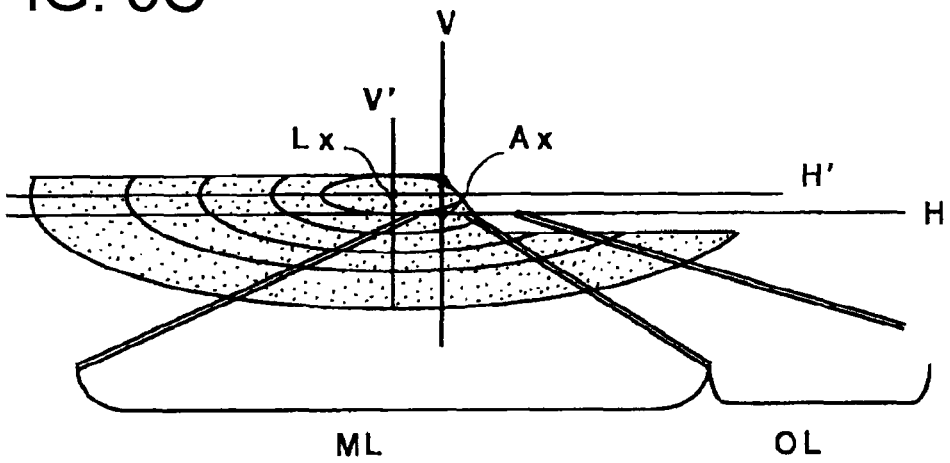
Figure 6A:
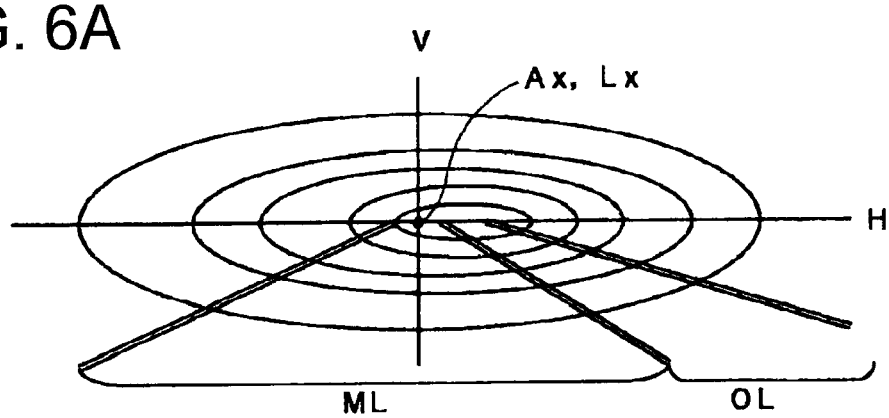
FIG. 6 shows views of shaded regions of a shade and light distribution patterns according to the modes of a second embodiment.
Figure 6B:
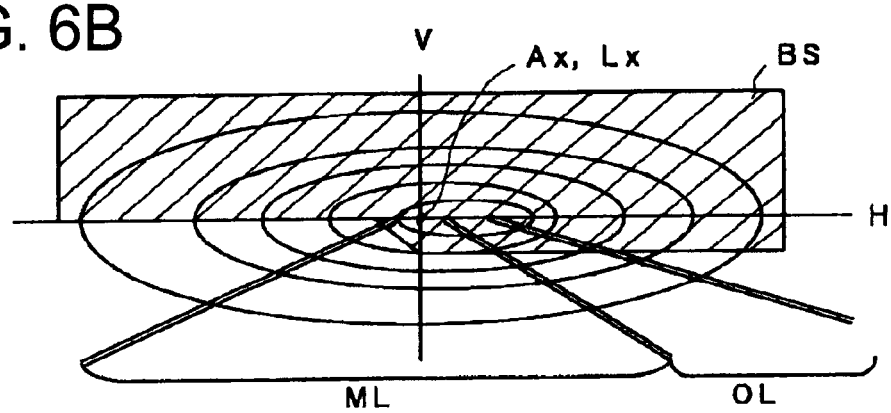
Figure 6C:
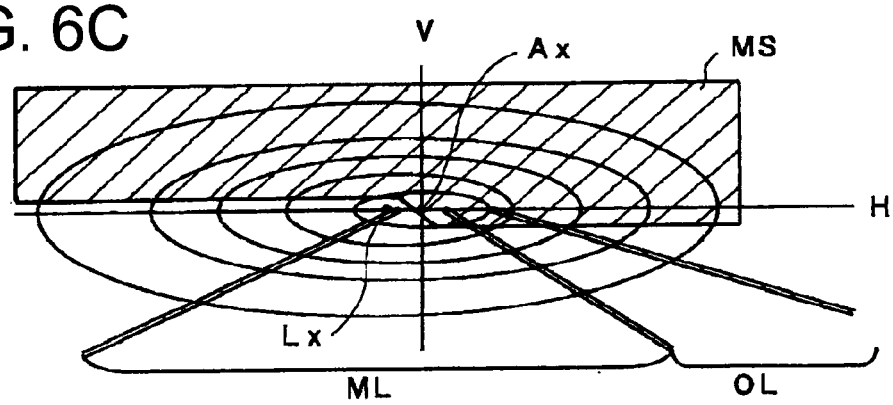
Figure 6D:
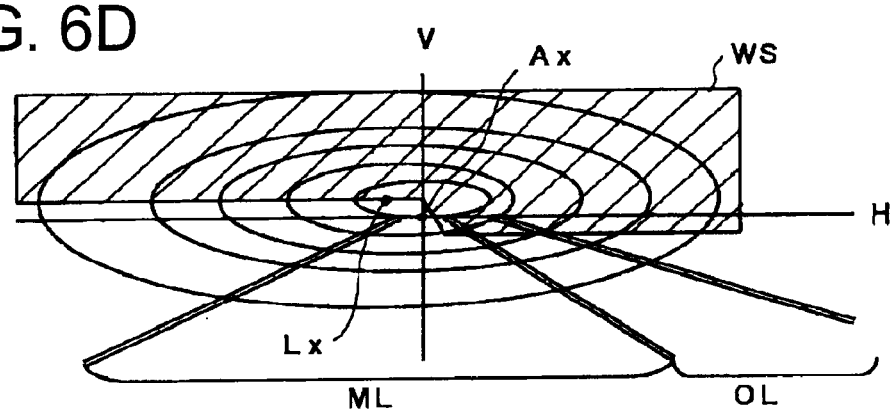

When the mode changeover switch 61 is changed from the basic mode shown in FIG. 5(*a*) (which is identical to FIG. 4(*a*)) to the wet road mode, the lamp control device 60 controls rotation of the rotary shade 26 using the rotational shade mechanism 30 to achieve a state in which the wet road plate WS is rotationally positioned within the path of reflected light from the reflector 21 of the projector lamp unit 20. At the same time, as shown in FIG. 5(*c*), the swivel mechanism 50 is used to control leftward deflection of the lamp optical axis Lx of the projector lamp unit 20 with respect to the straight travel axis Ax of the host vehicle, and the leveling mechanism 40 is used to face the lamp optical axis Lx somewhat more upward than the horizontal line H passing through the straight travel axis Ax of the host vehicle. Therefore, the light distribution pattern of the headlamp attains a shaded condition in a shaded region due the wet road plate WS as shown in FIG. 2(*d*), and is thus a light distribution pattern that has a cut-off line at a position near the horizontal line H to the right of the straight travel axis Ax, and a cut-off line at a position higher than the horizontal line H to the left of the straight travel axis Ax, as shown in FIG. 5(*c*). By increasing a swivel amount in the leftward direction somewhat more than that for the motorway mode, the oblique cut-off line is positioned practically in the vicinity of the straight travel axis Ax similar to the motorway mode. A majority of the high light intensity region is not shaded by the wet road plate WS, and the high light intensity region faces a road shoulder to the left of the host vehicle lane ML. Accordingly, a directly forward region of the host vehicle lane ML is illuminated by a region of low light intensity further downward of the lamp optical axis Lx. Therefore, illumination of a region of the oncoming vehicle lane OL to the right of the host vehicle lane ML is suppressed, while the high light intensity region distributes light to a left forward region of the host vehicle lane ML in order to illuminate an area spanning a road shoulder region ahead of the host vehicle and a forward region of the host vehicle lane ML. Furthermore, the directly forward region of the host vehicle lane ML is reduced in brightness. Thus, light from the host vehicle that is reflected off a wet road surface in a directly forward region of the host vehicle lane ML is prevented from dazzling the driver of an oncoming vehicle or a preceding vehicle.

When changing from the basic mode to the wet road mode here, as shown in FIG. 5(*b*), leftward swiveling of the lamp optical axis Lx is preferably controlled first and the rotary shade 26 is subsequently changed to the wet road plate WS. Provided that the timing at which leveling of the lamp optical axis Lx is controlled upward occurs after the control for leftward swiveling, the changeover to the wet road plate WS may occur beforehand or afterward. The reason is the same as for the motorway mode. If the shade is changed first, then substantially the entire high light intensity region is set to a non-shaded state with the lamp optical axis Lx facing the straight travel axis Ax. As a consequence, the driver of an oncoming vehicle or a preceding vehicle may be dazzled. By first swiveling the lamp optical axis Lx leftward, even if substantially the entire high light intensity region is not shaded, there is no dazzling of the driver of an oncoming vehicle or a preceding vehicle because the lamp optical axis Lx is already deflected leftward of the straight travel direction. For the same reasons as given above, when changing from the wet road mode to the basic mode, it is preferable that the rotary shade 26 is changed from the wet road plate WS to the basic plate BS first, after which swiveling of the lamp optical axis Lx is controlled so as to return to facing the straight travel axis Ax. Provided that the timing at which leveling of the lamp optical axis Lx is controlled to face the straight travel axis Ax comes after the changeover to the basic plate BS, the control for swiveling may occur beforehand or afterward.

According to the headlamp of the first embodiment as described above, the high beam mode can obtain a light distribution pattern appropriate for country driving by using the rotary shade 26 to set a non-shaded state, and the basic mode can obtain a light distribution pattern appropriate for city driving by changing the rotary shade 26 so that light is shaded with the basic plate BS. A light distribution pattern suitable for a motorway driving condition can be obtained by changing the rotary shade 26 so that light is shaded with the motorway plate MS and by controlling the swivel of the lamp optical axis Lx in the horizontal direction. A light distribution pattern suitable for a wet road driving condition can be obtained by changing the rotary shade 26 so that light is shaded with the wet road plate WS and by controlling the swivel of the lamp optical axis Lx in the horizontal direction and controlling upward leveling. Accordingly, in the basic mode it possible to brightly illuminate ahead of the host vehicle without dazzling the driver of an oncoming vehicle or a preceding vehicle. In the motorway mode it is possible illuminate a far distance ahead of the host vehicle lane by utilizing a left region of the high light intensity region near the center of light distribution while also preventing dazzling of the driver of an oncoming vehicle. Furthermore, in the wet road mode dazzling of an oncoming vehicle or a preceding vehicle is prevented by lowering illumination of a directly forward region of the host vehicle lane, while at the same time a region up to a far distance ahead of the host vehicle lane is illuminated. Therefore, a light distribution suitable for the wet road mode can be obtained without providing a particular shade for use in the wet road mode, which enables a simpler headlamp structure.

Second Embodiment

FIG. 6 shows views of light distributions according to the modes of a second embodiment. The basic structure of the headlamp of the second embodiment is identical to the headlamp of the first embodiment illustrated in FIG. 1. However, the center of the high light intensity region of the projector lamp unit 20 is deflected so as to face somewhat more rightward than the lamp optical axis Lx. This can be realized, for example, by displacing the light source 25 of the projector lamp unit 20 somewhat more leftward than the focal point of the reflector 21. By configuring the headlamp in this manner, in the high beam mode where light is not blocked by the rotary shade 26 as shown in FIG. 6(*a*), a light distribution pattern in which the high light intensity region is displaced rightward with respect to the lamp optical axis Lx is formed. In addition, the light intensity contour lines are closer together in the right region, and somewhat less so in the left region. Namely, in the left region of the light distribution, the light intensity distribution has a gradual inclination and illumination regions of the same light intensity are set wide, whereas in the right region, the light intensity distribution has a sharp inclination and illumination regions of the same light intensity are set more narrow. In the high beam mode, the lamp optical axis Lx coincides with the straight travel axis Ax, and the high light intensity region irradiates a distant forward region of the host vehicle lane ML and the oncoming vehicle lane OL. No preceding vehicle or oncoming vehicle is present, so there is no risk of dazzle. Thus, a light distribution for the high beam mode appropriate for country driving is achieved that brightly illuminates a far distance ahead, broadly illuminates a region from the host vehicle lane ML to the road shoulder in the directly forward region of the host vehicle, and illuminates a limited region of the oncoming vehicle lane OL.

In the basic mode, the basic plate BS shades light as shown in FIG. 6(*b*). The basic plate BS has the same structure as in the first embodiment, and a shaded region is set with respect to the lamp optical axis Lx. Therefore, in the second embodiment the entire high light intensity region is shaded by the basic plate BS. In particular, the high light intensity region is displaced rightward with respect to the lamp optical axis Lx, and consequently the high light intensity region is reliably shaded by the oblique cut-off line of the basic plate BS. As evident from a comparison of FIG. 6(*b*) and FIG. 2(*b*), in the first embodiment a portion in the left region of the high light intensity region is not shaded by the oblique cut-off line and illuminates the host vehicle lane ML, while in the second embodiment the brightness of the distant forward region of the host vehicle lane ML is prevented from becoming excessive, thus preventing dazzling of the driver of an oncoming vehicle as well as dazzling of the driver of a preceding vehicle or a pedestrian. Meanwhile, the left region where the light intensity contour lines are not as close together broadly illuminates a region from directly forward of the host vehicle lane ML to the road shoulder, and the right region where the light intensity contour lines are closer together can brightly illuminate a limited directly forward region of the oncoming vehicle lane OL. Accordingly, a light distribution for the basic mode appropriate for city driving is achieved.

In the motorway mode, the motorway plate MS shades light as shown in FIG. 6(*c*). The motorway plate MS is structured such that the right and left cut-off lines are the same as in the first embodiment, although the oblique cut-off line is displaced more rightward of the lamp optical axis Lx compared to the first embodiment, and practically the entire right half of the high light intensity region is shaded. In the motorway mode, the lamp optical axis Lx is swiveled leftward and the oblique cut-off line of the motorway plate MS is deflected so as to practically coincide with the straight travel axis Ax. As a consequence, the high light intensity region does not illuminate the oncoming vehicle lane OL and dazzling of the driver of an oncoming vehicle present a far distance ahead is prevented. Meanwhile, substantially the entire left half of the high light intensity region faces a far distance ahead of the host vehicle lane ML and brightly illuminates the distant forward region. At the same time, the left region where the light intensity contour lines are not as close together broadly illuminates a region from directly forward of the host vehicle lane ML to the road shoulder. Accordingly, a light distribution for the motorway mode appropriate for high speed driving is achieved that brightly illuminates the host vehicle lane ML over a broad range.

In the wet road mode, the wet road plate WS shades light as shown in FIG. 6(*d*). The wet road plate WS is structured such that the right and left cut-off lines are the same as in the first embodiment, although the oblique cut-off line is displaced more rightward of the lamp optical axis Lx compared to the first embodiment, and only a portion of the right half region of the high light intensity region is shaded. In the wet road mode, the lamp optical axis Lx is swiveled leftward and leveling of the lamp optical axis Lx is controlled somewhat upward, while the oblique cut-off line of the wet road plate WS is set so as to substantially coincide with the straight travel axis Ax. In other words, the oblique cut-off line of the wet road plate WS is displaced more rightward than the oblique cut-off line of the motorway plate MS. Therefore, a leftward swivel amount in the wet road mode is greater than a swivel amount in the motorway mode. Thus, substantially the entire high light intensity region excluding a right portion thereof faces and extremely brightly illuminates a far distance ahead of the host vehicle lane ML, and at the same time, the left region where the light intensity contour lines are not as close together illuminates a region from directly forward of the host vehicle lane ML to the road shoulder. However, since the lamp optical axis Lx faces upward, a directly forward region of the host vehicle lane ML is illuminated by a region of low light intensity. Thus, a light distribution for the wet road mode appropriate for driving in rainy weather is achieved that brightly illuminates a far distance ahead of the host vehicle lane ML, and also lowers the light intensity of the directly forward region to suppress light reflecting off a wet road surface, which prevents dazzling of the driver of a preceding vehicle or an oncoming vehicle.

Third Embodiment

Figure 7:
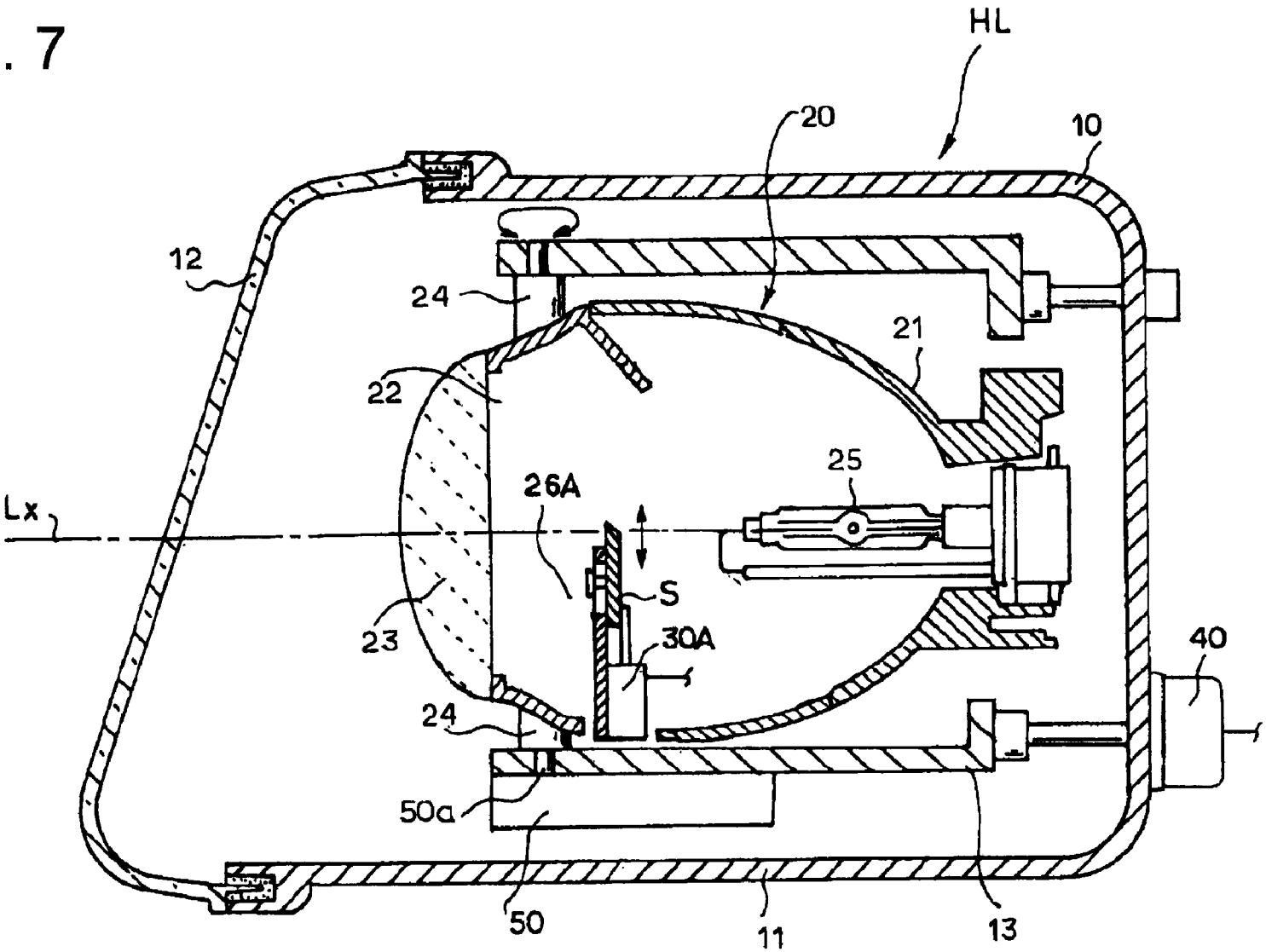
FIG. 7 is a cross-sectional view of the headlamp according to a third embodiment.

In the first and second embodiments, a rotary shade is used to change a shade plate and modify a shaded region. However in the third embodiment, a slide shade is used as the shade of the projector lamp unit 20. FIG. 7 is a cross-sectional view of the headlamp HL according to the third embodiment. Portions identical to that in FIG. 1 are indicated by like reference numerals and detailed descriptions of such portions are omitted in the following paragraphs. A slide shade 26A acting as the shading means has one shade plate S, which is processed such that a shape of an upper edge forms a required cut-off line, and a reciprocal shade mechanism 30A that vertically and laterally moves the shade plate S and sets its mobility position. The slide shade 26A is integrated within the projector lamp unit 20. By driving the reciprocal shade mechanism 30A to guide a height position of the upper edge of the shade plate S from high to low and thus changing to preset first, second, and third positions, it is possible to change between the shaded states of basic shading, motorway shading, and wet road shading. Basic shading includes setting the shade plate S to the first position, i.e., setting the upper edge to the highest position, to form a shaded region identical to that formed by the basic plate BS of the first embodiment shown in FIG. 2(*b*). Motorway shading includes setting the shade plate S to the second position that is somewhat lower down from the first position to form a shaded region identical to that formed by the motorway plate MS of the first embodiment shown in FIG. 2(*c*). Wet road shading includes moving the shade plate S from this position somewhat leftward and to the third position that is displaced leftward of the second position to form a shaded region substantially identical to that formed by the wet road plate WS of the first embodiment shown in FIG. 2(*d*).

In this manner, the slide shade 26A is controlled by the reciprocal shade mechanism 30A to form the shaded regions of the modes, and at the same time, leveling and swiveling of the lamp optical axis Lx of the projector lamp unit 20 are controlled by the leveling mechanism 40 and the swivel mechanism 50, respectively, in a manner similar to the first embodiment. Similar to what is shown in FIGS. 4 and 5, during basic shading the lamp optical axis Lx of the projector lamp unit 20 remains facing the straight travel direction; however, during motorway shading swiveling of the lamp optical axis Lx is controlled leftward. During wet road shading, swiveling of the lamp optical axis Lx is controlled leftward and leveling thereof is controlled upward. Thus, respective light distribution patterns can be obtained similar to those in the first embodiment which are suitable for the traveling mode, the passing mode, the motorway mode, and the wet road mode.

In the motorway mode, the leveling mechanism 40 can control leveling of the lamp optical axis Lx somewhat downward. By controlling leveling downward, the high light intensity region is deflected downward of the horizontal line H that passes through the straight travel axis Ax of the host vehicle. This, in turn, is advantageous for increasing a brightness at a forward intermediate distance of the host vehicle lane ML and also effective for preventing dazzling of the driver of a preceding vehicle (if there is a preceding vehicle present).

The shade mechanism is not limited to the structures in the first and third embodiments. For example, an optically transparent type of liquid crystal device (LCD) may be used to substantially change a shaded region by electrically modifying a pattern of an optically non-transparent region.

The present invention is not limited to a headlamp that uses a projector lamp unit. It also can be applied to a headlamp that uses a reflector lamp formed of a separate reflector and condenser lens, provided that a shaded region can be changed and it is possible to control swiveling of the lamp optical axis in the horizontal direction and control leveling in the vertical direction.

Other implementations are within the scope of the claims.

What is claimed is:

1. A vehicular lamp system comprising:

shading means for partially shading light emitted from a lamp to vary a light distribution pattern;

shaded region changeover means for changing a shaded region using the shading means; and deflection control means for controlling deflection of a lamp optical axis in a lateral direction, wherein the shaded region changeover means is operable to change between a shaded state where a high light intensity region of an illumination region of the lamp is shaded and an unshaded state where a high light intensity region is not shaded, and the deflection control means is operable to laterally deflect the lamp optical axis in accordance with the shaded or unshaded state of the high light intensity region due to the shaded region changeover means.

2. The vehicular lamp system according to claim 1, wherein the lamp system is operable to switch between a basic mode and a motorway mode, where:

in the basic mode, the shaded region changeover means blocks light in substantially the entire high light intensity region and the deflection control means controls the lamp optical axis to a straight travel direction; and in the motorway mode, the shaded region changeover means does not block light in the high light intensity region, and the deflection control means controls deflection of the lamp optical axis to a host vehicle lane side.

3. The vehicular lamp system according to claim 1 further comprising leveling means for controlling deflection of an illumination optical axis of the lamp in a vertical direction.

4. The vehicular lamp system according to claim 3, wherein the lamp system is operable to switch between a basic mode and a wet road mode, where:

in the basic mode, the shaded region changeover means blocks light in the high light intensity region and the deflection control means controls the lamp optical axis to a straight travel direction; and in the wet road mode, the shaded region changeover means does not block light in the high light intensity region, the deflection control means controls deflection of the lamp optical axis to a host vehicle lane side, and the leveling means controls deflection of the lamp optical axis upward.

5. The vehicle lamp system according to claim 1 further comprising leveling means for controlling deflection of an illumination optical axis of the lamp in a vertical direction, wherein the lamp system is operable to switch among a basic mode, a motorway mode, and a wet road mode, where:

in the basic mode, the shaded region changeover means blocks light in the high light intensity region and the deflection control means controls the lamp optical axis to a straight travel direction;

in the motorway mode, the shaded region changeover means does not block light in the high light intensity region, and the deflection control means controls deflection of the lamp optical axis to a host vehicle lane side; and in the wet road mode, the shaded region changeover means does not block light in the high light intensity region, the deflection control means controls deflection of the lamp optical axis to the host vehicle lane side, and the leveling means controls deflection of the lamp optical axis upward, wherein the vehicle lamp system is arranged so that when changing from the basic mode to the motorway mode or the wet road mode, at least one of the deflecting means or the leveling means performs a deflecting control or a leveling control, respectively, before a shaded region changeover control of the shaded region changeover means, and when changing from the motorway mode or the wet road mode to the basic mode, the shaded region changeover control of the shaded region changeover means is performed before the deflecting control or the leveling control.

6. The vehicular lamp system according to claim 5 wherein the shading means has right and left horizontal cut-off lines of different heights, as well as an oblique cut-off line that connects the right and left horizontal cut-off lines, and the shaded region changeover means is operable to change a horizontal position of the oblique cut-off line in the motorway mode and the wet road mode, and the deflection control means is operable to set the oblique cut-off line substantially to identical horizontal positions in the motorway mode and the wet road mode.

7. A vehicular lamp system comprising:

a shade operable to partially shade light emitted from a lamp to vary a light distribution pattern;

a rotational shade device operable to change a shaded region using the shade; and a deflection control device operable to control deflection of a lamp optical axis in a lateral direction, wherein the shade is further operable to change between a shaded state where a high light intensity region of an illumination region of the lamp is shaded and an unshaded state where a high light intensity region of an illumination region is not shaded, and the deflection control device is further operable to laterally deflect the lamp optical axis in accordance with the shaded or unshaded state of the high light intensity region.

8. The vehicle lamp system according to claim 7 further comprising a leveling device operable to control deflection of an illumination optical axis of the lamp in a vertical direction, wherein the lamp system is operable to switch among a basic mode, a motorway mode, and a wet road mode, where:

in the basic mode, the rotational shade device blocks light in the high light intensity region and the deflection control device sets the lamp optical axis in a straight travel direction;

in the motorway mode, the rotational shade device does not block light in the high light intensity region, and the deflection control device deflects the lamp optical axis to a host vehicle lane side; and in the wet road mode, the rotational shade device does not block light in the high light intensity region, the deflection control device deflects the lamp optical axis to the host vehicle lane side, and the leveling device deflects the lamp optical axis upward, wherein the vehicle lamp system is arranged so that when changing from the basic mode to the motorway mode or the wet road mode, at least one of the deflection control device or the leveling device performs a deflecting control or a leveling control, respectively, prior to changing a shaded region with the rotational shade device, and when changing from the motorway mode or the wet road mode to the basic mode, the rotational shade device changes a shaded region prior to operation of the deflection control device or the leveling device.

* * * * *